US009297054B2

(12) United States Patent
Konyashin et al.

(10) Patent No.: US 9,297,054 B2
(45) Date of Patent: Mar. 29, 2016

(54) CEMENTED CARBIDE ARTICLE AND METHOD FOR MAKING SAME

(75) Inventors: Igor Yurievich Konyashin, Huenfeld (DE); Bernd Heinrich Ries, Huenfeld (DE); Frank Friedrich Lachmann, Burghaun (DE); Christina Lachmann, legal representative, Burghaun (DE)

(73) Assignee: Element Six GmbH, Burghaun (DE)

( * ) Notice: Subject to any disclaimer, the term of this patent is extended or adjusted under 35 U.S.C. 154(b) by 0 days.

(21) Appl. No.: 13/980,635

(22) PCT Filed: Jan. 17, 2012 (Under 37 CFR 1.47)

(86) PCT No.: PCT/EP2012/050619
§ 371 (c)(1), (2), (4) Date: Sep. 23, 2014

(87) PCT Pub. No.: WO2012/098102
PCT Pub. Date: Jul. 26, 2012

(65) Prior Publication Data

US 2015/0050512 A1 Feb. 19, 2015

(30) Foreign Application Priority Data

Jan. 20, 2011 (GB) ..... 1100966.9

(51) Int. Cl.

| | |
|---|---|
| ***B22F 7/00*** | (2006.01) |
| ***C22C 29/08*** | (2006.01) |
| ***B22F 3/10*** | (2006.01) |
| ***B22F 7/06*** | (2006.01) |
| ***B22F 3/24*** | (2006.01) |

(52) U.S. Cl.
CPC . *C22C 29/08* (2013.01); *B22F 3/10* (2013.01); *B22F 3/1028* (2013.01); *B22F 3/24* (2013.01); *B22F 7/06* (2013.01); *B22F 2003/248* (2013.01); *B22F 2301/15* (2013.01); *B22F 2301/35* (2013.01); *B22F 2302/10* (2013.01); *Y10T 428/12139* (2015.01)

(58) Field of Classification Search
USPC ..... 75/240, 241; 428/469, 472, 697, 698, 428/699
See application file for complete search history.

(56) References Cited

U.S. PATENT DOCUMENTS

| | | | |
|---|---|---|---|
| 4,401,297 | A | 8/1983 | Doi et al. |
| 4,610,931 | A | 9/1986 | Nemeth et al. |

(Continued)

FOREIGN PATENT DOCUMENTS

| | | | |
|---|---|---|---|
| JP | 60110838 | A | 6/1985 |
| JP | 06287611 | A | 10/1994 |

(Continued)

*Primary Examiner* — Archene Turner
(74) *Attorney, Agent, or Firm* — Dean W. Russell; Clark F. Weight; Kilpatrick Townsend & Stockton LLP

(57) ABSTRACT

The present invention relates to a cemented carbide article comprising a core of metal carbide grains and a binder selected from cobalt, nickel, iron and alloys containing one or more of these metals and a surface layer defining an outer surface for the article, the surface layer comprising 5 to 25 weight percent of tungsten and 0.1 to 5 weight percent carbon, the balance of the surface layer comprising a metal or alloy selected from the binder metals and alloys and the surface layer being substantially free of carbide grains as determined by optical microscopy or SEM. A method for the production of a cemented carbide article is also provided.

18 Claims, 4 Drawing Sheets

(56) References Cited

U.S. PATENT DOCUMENTS

Figure 1A:
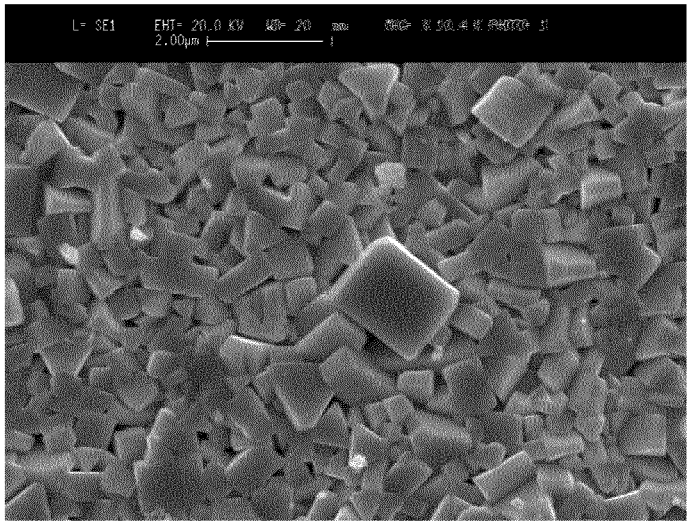

| | | | | | |
|---|---|---|---|---|---|
| 4,649,084 | A | * | 3/1987 | Hale et al. | 428/698 |
| 4,911,989 | A | | 3/1990 | Minoru et al. | |
| 5,106,674 | A | | 4/1992 | Okada et al. | |
| 5,232,318 | A | * | 8/1993 | Santhanam et al. | 51/309 |
| 5,283,030 | A | * | 2/1994 | Nakano et al. | 419/53 |
| 5,310,605 | A | | 5/1994 | Baldoni, II et al. | |
| 5,500,289 | A | | 3/1996 | Gavish | |
| 5,577,424 | A | | 11/1996 | Isobe et al. | |
| 5,643,658 | A | * | 7/1997 | Uchino et al. | 428/699 |
| 5,729,823 | A | * | 3/1998 | Gustafson et al. | 428/697 |
| 6,080,477 | A | * | 6/2000 | Narasimhan | 428/698 |
| 6,207,102 | B1 | | 3/2001 | Rohlin et al. | |
| 6,299,992 | B1 | * | 10/2001 | Lindskog et al. | 428/698 |
| 6,761,750 | B2 | * | 7/2004 | Zackrisson et al. | 75/241 |
| 7,588,833 | B2 | * | 9/2009 | Hashe et al. | 75/240 |
| 2009/0169315 | A1 | * | 7/2009 | Larsson et al. | 407/119 |

FOREIGN PATENT DOCUMENTS

| | | | |
|---|---|---|---|
| JP | 06336635 | A | 12/1994 |
| JP | 2006346777 | A | 12/2006 |

* cited by examiner

CEMENTED CARBIDE ARTICLE AND METHOD FOR MAKING SAME

CROSS REFERENCE TO RELATED APPLICATIONS

This application is the U.S. national phase of International Application No. PCT/EP2012/050619 filed on Jan. 17, 2012, and published in English on Jul. 26, 2012 as International Publication No. WO 2012/098012 A1, which application claims priority to Great Britain Patent Application No. 1100966.9 filed on Jan. 20, 2011, the contents of both of which are incorporated herein by reference.

This disclosure relates generally to cemented carbide articles and a method for manufacturing such articles.

The surface of tungsten carbide—cobalt (WC—Co) cemented carbide materials including up to 10 wt. % Co (after sintering) may contain very little Co and there may be only naked WC grains visible on the surface. Such a surface is likely to exhibit reduced fracture toughness and strength, which may be associated with relatively large gaps between WC grains having reduced Co content at the surface. Such gaps can be considered as micro-cracks, which can relatively easily be opened up at low loads leading to the initiation and propagation of further cracks and ultimately failure of the whole carbide article. Another disadvantage of the surface layer containing very little Co is that the wettability of such a layer by various brazing solders tends to be very poor during brazing, which leads to poor bonding between the carbide articles and steel and tends to result in poor quality of brazed wear-parts and tools. These disadvantages also apply to WC-based carbide grades comprising binder material containing other Fe-group metals and their alloys (Ni and/or Fe). It is likely to be very difficult to remove the surface layer containing little or no Co by grinding cemented carbide articles that have a complicated shape. In some cases, it may not be economically reasonable to grind carbide articles after sintering.

U.S. Pat. No. 4,830,930 discloses a surface-refined sintered alloy body comprising a hard phase containing at least one selected from the group including carbides of the metals of the groups 4a, 5a and 6a of the periodic table and a binding phase containing at least one selected from iron group metals. The concentration of the binding phase is highest at the outermost surface and approaches the concentration of the inner portion.

United States patent application publication number 2004/0211493A1 discloses a method for making a cemented carbide article with a high Co content on the surface. The method comprises heat-treatment of the carbide article in a vacuum at 1000 to 1400° C. and fast cooling in nitrogen.

Viewed from a first aspect there is provided a cemented carbide article comprising a core of metal carbide grains and a binder selected from cobalt, nickel, iron and alloys containing one or more of these metals and a surface layer defining an outer surface for the article, the surface layer comprising 5 to 25 weight percent of tungsten and 0.1 to 5 weight percent carbon, the balance of the surface layer comprising a metal or alloy selected from the binder metals and alloys and the surface layer being substantially free of carbide grains as determined by optical microscopy or SEM.

Various combinations and arrangements are envisaged by this disclosure, non-limiting and not-exhaustive examples of which are described below.

In example arrangements, the surface layer may have thickness of at least about 1 micron and at most about 50 microns, and may include Co, Ni and/or Fe and dissolved tungsten and carbon.

In some example arrangements, the surface layer thickness may be at least about 2 microns and at most about 20 microns.

In some example arrangements, the surface layer may be substantially continuous over a surface of the article, and in some arrangements the surface layer can be at least 96%, 97%, 98%, 99% or 100% of the surface area of the article.

In some example arrangements, the surface layer may consist essentially of 5-25 wt. % tungsten and approximately 0.1-5 wt. % carbon, Co, Ni and/or Fe or their alloys and optionally grain growth inhibitors (for example V, Cr, Ta, etc.) otherwise included in the carbide articles.

In some example arrangements, the surface layer may comprise approximately 10-15 wt. % tungsten and approximately 1-4 wt. % carbon. In one arrangement, the surface layer may further comprise one or more of approximately 0.1-10 wt. % V, approximately 0.1-10 wt. % Cr, approximately 0.1-5 wt. % Ta, approximately 0.1-5 wt. % Ti, approximately 0.5-15 wt. % Mo, approximately 0.1-10 wt. % Zr, approximately 0.1-10 wt. % Nb and approximately 0.1-10 wt. % Hf.

In some example arrangements, the crystal lattice parameter of Co, Ni and/or Fe or their alloys with the face-centred cubic crystal lattice in the surface layer may be higher compared to corresponding metals or alloys by at least 0.01%. Without being bound by theory, this may be as a result of tungsten dissolved in the coating.

In some example arrangements, the surface layer may be under residual tensile strength of approximately 10 to 500 MPa. This can be measured by the grazing incident XRD method using the iso-inclination sin 2ψ method as described by M. Fitzpatrick, T. Fry, P. Holdway , et al. NPL Good Practice Guide No. 52: Determination of Residual Stresses by X-ray Diffraction —Issue 2. September 2005.

In some example arrangements, there may be an intermediate layer (or "interlayer") between the surface layer and the article core region, the interlayer having a thickness of 0.5 micron to 40 microns and consists of WC grains and a binder comprising Co, Ni and/or Fe; the binder content in the interlayer being higher compared to the core region by at least 5%. The binder content in interlayer may gradually decrease from the coating towards the core region.

In some example arrangements, the indentation fracture toughness of the surface layer may be higher than cemented carbide articles without surface layer by at least 50%.

In some example arrangements, the transverse rupture strength of unground articles with coating may be higher than not-ground articles without coating by at least 20%.

The cemented carbide of the article may be cemented tungsten carbide.

Disclosed cemented carbide articles may have the aspect of enhanced transverse rupture strength (TRS) and fracture toughness. The coating can also contain grain growth inhibitors (V, Cr, Ta, etc.) otherwise included in the carbide articles. The TRS of such carbide articles has been found to be significantly enhanced and the fracture toughness of the surface layer to be significantly improved. The presence of the surface layer or skin also significantly improves their wettability by brazing solders, which is likely to result in improved bonding between the articles and steel, for example.

Viewed from a second aspect there is provided a method of making a cemented carbide article according to this disclosure, the method including forming a mixture of metal carbide grains and a binder selected from cobalt, iron and nickel and alloys containing one or more of these metals; pressing the mixture into the form of an article; sintering the article at a sintering temperature, and cooling the sintered article to a temperature at which the binder is substantially solid, in an inert gas, nitrogen, hydrogen or a mixture thereof in at least three cooling stages, the cooling rate of the first stage being greater than that of the second stage which is greater than that of the third stage.

The sintering of the article may takes place at a temperature of about 1400° C. to 1500° C. in a vacuum or inert gas under pressure. Suitable inert gases are helium, neon, argon, krypton, xenon and radon.

In one version of the disclosed method, the cooling of the article may take place over at least three stages at an average cooling rate of approximately 0.01 to 4 degrees centigrade per minute, wherein the first stage cooling is from the sintering temperature to 1380° C., the second cooling stage is from 1380° C. to 1340° C. and the third cooling stage is from 1340° C. to 1280° C., and wherein the cooling rate in the third stage is from 0.01 to 1 degrees Centigrade per minute, the cooling rate in the second stage is higher than that the second cooling stage by a factor of two, and the cooling rate in the first cooling stage is higher than that of the third cooling stage by a factor of at least five. The article may be cooled from 1280° C. to 1250° C. at the cooling rate as that of the third stage. This cooling regime has been found to produce a cemented carbide article having a surface layer described above and the advantages of improved transfer rupture strength and fracture toughness in a commercially acceptable sintering time. A cemented carbide article is produced with the advantages mentioned above without sacrificing productivity.

Figure 1B:
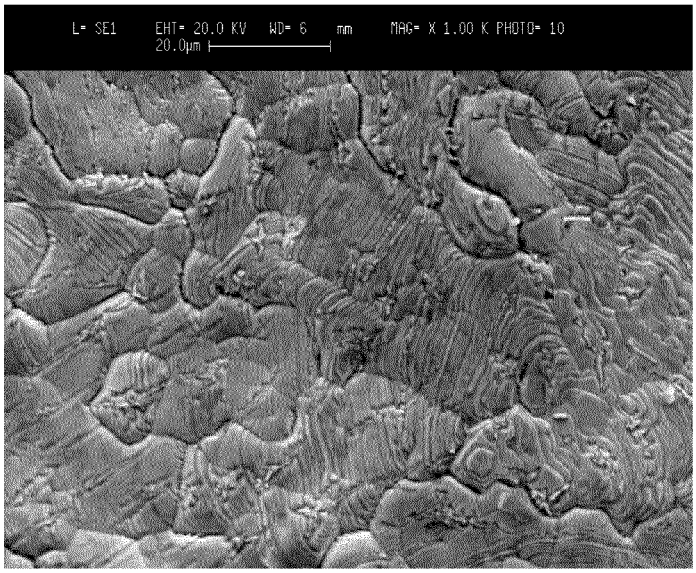
Figure 2:
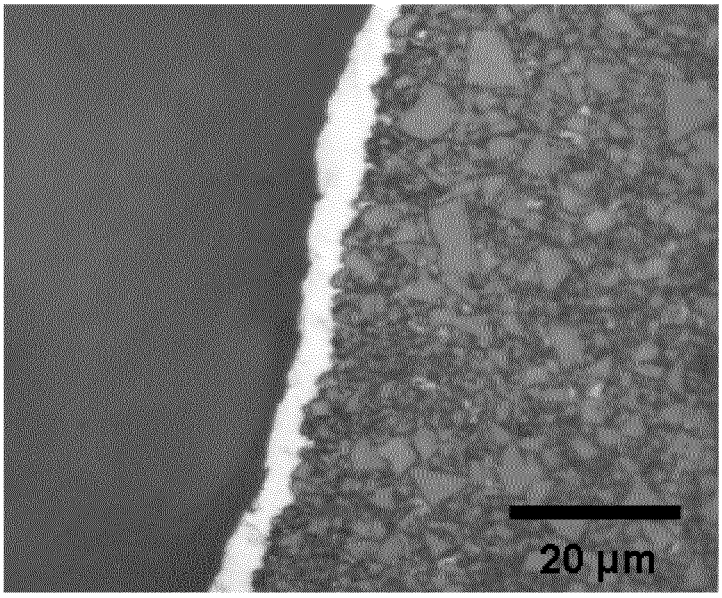
Figure 3A:
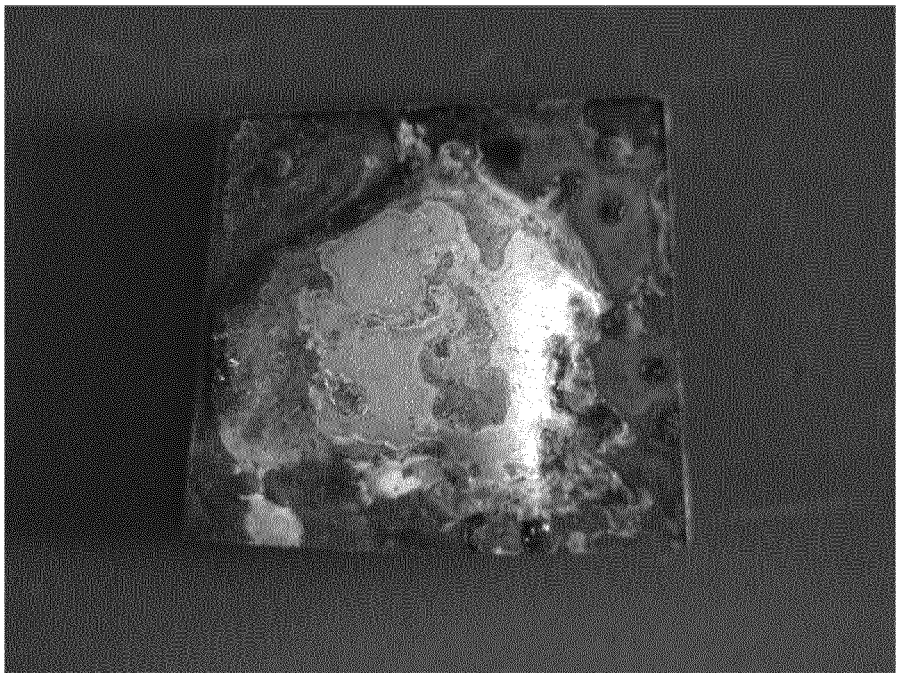
Figure 3B:
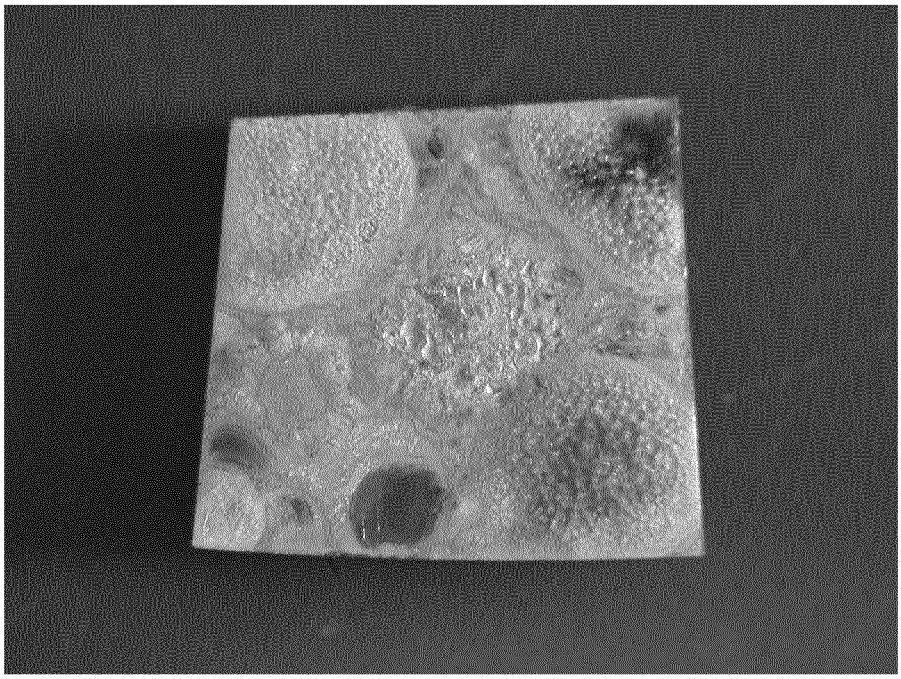
Figure 4A:
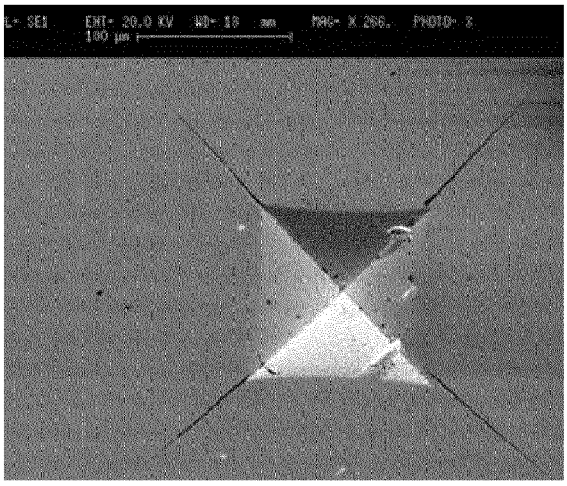
Figure 4B:
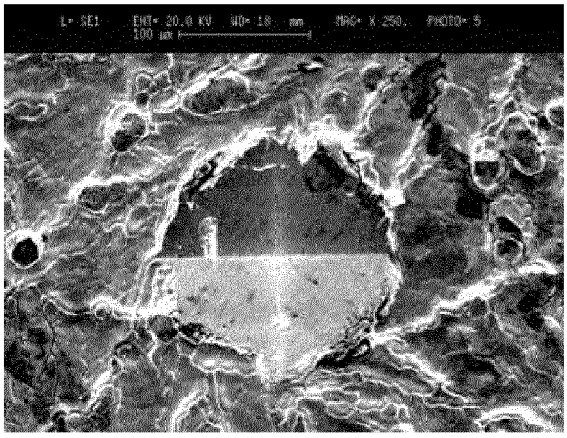
Figure 4C:
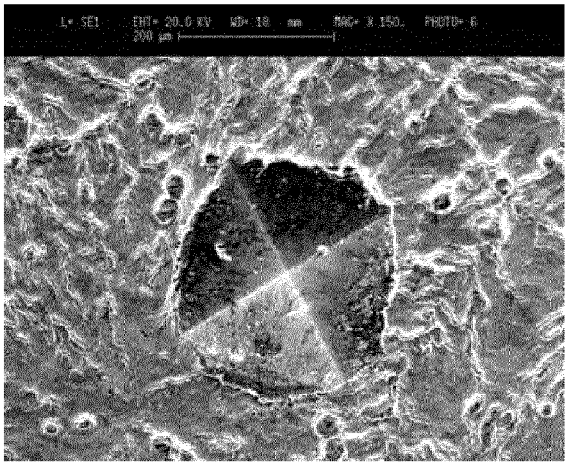

Non-limiting examples are described in detail below with reference to the accompanying figures, of which FIG. 1A shows a micrograph of the surface of K20 after sintering according to Example 1, and FIG. 1B shows a micrograph of the surface of K20 after the formation of the Co-based surface layer as a result of sintering according to Example 2;

FIG. 2 shows a micrograph of a metallurgical cross-section with the Co-based surface on K20 obtained according to Example 2;

FIG. 3A shows articles of NK07 after sintering according to Example 3 and FIG. 3B shows articles of NK07 with the Co/Ni surface layer after sintering according to Example 4, both subjected to the Cu-based brazing solder (2168, Brazetech) at a temperature of approximately 1200° C. for 2 minutes; and FIG. 4A shows Vickers indentations on the surface of NK07 after sintering according to Example 3, load of 30 kg, FIG. 4B shows Vickers indentations on the surface of NK07 with the Co—Ni-based surface layer after sintering according to Example 4, load of 30 kg and FIG. 4C shows Vickers indentations on the surface of NK07 with the Co—Ni-based surface layer after sintering according to Example 4, load of 100 kg.

In the Examples which follow, wt.=weight and min=minutes

Example 1(Comparartive Example)

Cemented carbide articles of the K20 grade containing WC, 6 wt. % Co and 0.2 wt. % VC with WC mean grain size of roughly 1 μm were sintered at 1420° C. for 75 min (45 min vacuum and 30 min HIP at 40 Bar). Afterward the articles were cooled down in Ar at a average cooling rate of 10 degrees per minute. As a result, their surface layer contained WC grains and approximately 0.5 wt. % Co which was established by Energy Dispersive X-Ray Analysis (EDX). The surface of K20 cemented carbide article after sintering is shown in FIG. 1A. The TRS value established by use of unground rods of 8 mm in diameter and 25 mm in length was equal to 1740 MPa. The indentation fracture toughness obtained at a load of 30 kg was equal to 10.1 MPa m1/2. The wettability of the surface by a Cu-based brazing solder (2168, Brazetech) after heat-treatment at 1200° C. for 2 min was relatively poor, as only approximately 40% of surface of a plate of approximately 19×19 mm was covered by the solder.

Example 2

Cemented carbide articles of the K20 grade were sintered at 1420° C. for 75 min (45 min vacuum and 30 min HIP at 40 Bar). Afterwards, a mixture of ⅓ argon, ⅓ hydrogen and ⅓ nitrogen at pressure of 1.5 Bar was introduced into the furnace and the articles were cooled down to 1250° C. at an average cooling rate of 2 degrees per minute. The cooling rate was equal to 4.5 degrees per minute between 1420° C. and 1380° C., 1 degree per minute between 1380° C. and 1340° C., and 0.5 degree per minute between 1340° C. and 1280° C. as well as between 1280° C. and 1250° C.; afterwards the cooling rate was uncontrolled down to room temperature. As a result, a continuous Co-based surface layer was formed on the article. The appearance of the surface layer is shown in FIG. 1B and a cross-section with the surface layer is shown in FIG. 2 indicating that the surface layer thickness was approximately 3 to 5 microns. No WC grains were found in the Co-based coating by means of optical microscopy and SEM on the cross-section of the cemented carbide article with the coating. According to the results of Auger Electron Spectroscopy (AES) of the composition of the surface layer obtained after removing approximately 300 nm (nanometres) of the surface layer by Ar ion sputtering, was found to be the following (wt. %): W—10.9, V—3.1, C—2.7, the balance being Co. AES was used in this Example rather than the EDX method used in the comparative Example 1 because in Example 1 the detected zone needed to be sufficiently thick (of the order of several microns) to measure the low Co concentration in the whole near-surface layer of the carbide article, whereas in Example 2 the detected zone needed to be very thin to measure the composition of only the Co-based coating (the thickness of the analysed layer is well below 0.5 μm after Ar ion sputtering).

There was an interlayer between the surface layer and the article core of nearly 5 μm in thickness comprising WC grains and the Co-based binder; the average Co content in the interlayer was equal to 10 wt. %. The TRS value established by use of unground rods of 8 mm in diameter and 25 mm in thickness was equal to 2520 MPa, which is higher compared to samples of Example 1 by nearly 45%. The indentation fracture toughness of the surface layer of the articles of this example was dramatically improved, as no Palmquist cracks, which are cracks typically forming on ceramic materials during Vickers indentation, were visible near the Vickers indentations obtained at a load of 30 kg. The wettability of the surface by the Cu-based brazing solder (2168, Brazetech) at 1200° C. for 2 min was perfect, as 100% of surface of a plate of approximately 19×19 mm was covered by the solder. XRD examinations indicated that the surface layer comprised only the face-centred cubic (fcc) Co modification. The crystal lattice parameter of the Co based surface layer was found to be 3.5447 Å, which is higher compared to that of pure Co by 0.017%. The surface layer was characterised by residual tensile stress of −76 MPa.

Example 3(Comparative)

Cemented carbide articles of the NK07 grade containing WC, 4.8 wt. % Co, 2 wt. % Ni, 0.3 wt % $Cr_3C_2$ and 0.3 wt. % VC with WC mean grain size of roughly 0.7 μm were sintered at 1420° C. for 75 min (45 min vacuum and 30 min HIP at 40 Bar). Afterward the articles were cooled down in Ar at an average cooling rate of 10 degrees per minute. As a result, their surface contained WC grains and only approximately 0.4 wt. % Co and 0.2 wt. % Ni, which was established by EDX. The TRS value established by use of unground rods of 8 mm in diameter and 25 mm in length was equal to 1290 MPa. The indentation fracture toughness obtained at a load of 30 kg was equal to 9.2 MPa m1/2. The wettability of the surface by the Cu-based brazing solder (2168, Brazetech) at 1200° C. for 2 min was relatively poor, as only approximately 50% of the surface of a plate of approximately 19×19 mm were covered by the solder, which can be seen in FIG. 3A.

Example 4

Cemented carbide articles of the NK07 grade were sintered at 1420° C. for 75 min (45 min vacuum and 30 min HIP at 40 Bar). Afterwards, a mixture of ⅓ argon, ⅓ hydrogen and ⅓ nitrogen at pressure of 1.5 Bar was introduced into the furnace and the articles were cooled down to 1250° C. at an average cooling rate of 2 degrees per minute. The cooling rate was equal to 4.5 degrees per minute between 1420° C. and 1380° C., 1 degree per minute between 1380° C. and 1340° C., and 0.5 degree per minute between 1340° C. and 1280° C. as well as between 1280° C. and 1250° C.; afterwards the cooling rate was uncontrolled down to room temperature. As a result, a continuous Co/Ni-based surface layer was formed on the article and the surface layer thickness was roughly 10 μm. According to the results of AES obtained after removing nearly 300 nm of the surface layer by Ar ion sputtering, the composition of the surface layer was the following (wt. %): W—12.3, V—3.4, Cr—1.9, Ni—18.1, C—2.6, the balance being Co. No carbide grains were detected by means of optical microscopy and SEM. There was an interlayer between the surface layer and the article core of nearly 7 μm in thickness comprising WC grains and the Co/Ni binder; the average Co content in the interlayer was equal to 9 wt. % and Ni content was equal 5 wt. %. The TRS value established by use of unground rods of 8 mm in diameter and 25 mm in length was equal to 1790 MPa, which is higher compared to the articles of Example 3 by nearly 39%. The indentation fracture toughness of the surface layer of the articles of this example was dramatically improved, as no Palmquist cracks were seen near the Vickers indentations obtained at a load of both 30 kg and 100 kg. This can be clearly seen in FIG. 4 compared to the long Palmquist cracks on the surface of NK07 according to Example 3. The wettability of the surface by the Cu-based brazing solder (2168, Brazetech) at 1200° C. for 2 min was perfect, as 100% of surface of a plate of approx. 19×19 mm was covered by the solder, which can be seen in FIG. 3B. XRD examinations indicated that the surface layer comprised only the face-centered cubic (fcc) Co modification. The crystal lattice parameter of the Co/Ni based surface layer was found to be 3.543 Å, which is higher compared to that the Co/Ni alloy by 0.011%. The surface was characterised by residual tensile stress of −173 MPa.

Certain terms and concepts as used herein are briefly explained below.

By "substantially continuous", a surface layer, for example, a homogenous surface layer, of at least 95% of the area of the surface of the article is intended.

The term "consisting essentially of" is intended to cover the specified materials as well as those that do not materially affect the basic characteristic(s) of the cemented carbide article of the invention.

The invention claimed is:

1. A cemented tungsten carbide article comprising a core of metal carbide grains and a binder selected from cobalt (Co), nickel (Ni) and iron (Fe), and a surface layer defining an outer surface for the article, the surface layer comprising 5 to 25 weight percent of tungsten (W) and 0.1 to 5 weight percent carbon (C), the balance of the surface layer comprising a metal or alloy selected from the binder metals and alloys; in which the surface layer is substantially free of carbide grains as determined by optical microscopy or scanning electron microscopy (SEM), has a thickness of at least 1 micron and at most 50 microns and includes cobalt (Co), iron (Fe) or nickel (Ni).

2. A cemented tungsten carbide article according to claim 1, in which the thickness of the surface layer is at least 2 microns and at most 20 microns.

3. A cemented tungsten carbide article according to claim 1, wherein the surface layer comprises 10 to 15 weight per cent tungsten (W) and 1 to 4 weight per cent carbon (C).

4. A cemented tungsten carbide article according to claim 1, wherein the surface layer comprises 0.1 to 10 weight per cent vanadium (V) or chromium (Cr).

5. A cemented tungsten carbide article according to claim 3, wherein the surface layer comprises 0.1 to 10 weight per cent vanadium (V) or chromium (Cr).

6. A cemented tungsten carbide article according to claim 1, wherein the surface layer comprises 0.1 to 5 weight per cent tantalum (Ta) or titanium (Ti).

7. A cemented tungsten carbide article according to claim 3, wherein the surface layer comprises 0.1 to 5 weight per cent tantalum (Ta) or titanium (Ti).

8. A cemented tungsten carbide article according to claim 1, wherein the surface layer comprises 0.5 to 15 weight per cent molybdenum (Mo).

9. A cemented tungsten carbide article according to claim 3, wherein the surface layer comprises 0.5 to 15 weight per cent molybdenum (Mo).

10. A cemented tungsten carbide article according to claim 1, wherein the surface layer comprises 0.1 to 10 weight per cent zirconium (Zr), 0.1 to 10 weight per cent niobium (Nb) and 0.1 to 10 weight per cent hafnium (Hf).

11. A cemented tungsten carbide article according to claim 1, wherein the surface layer consists essentially of 5 to 25 weight per cent tungsten (W) and 0.1 to 5 weight per cent carbon (C), cobalt (Co), nickel (Ni) or iron (Fe) or their alloys and optionally a grain growth inhibitor.

12. A cemented tungsten carbide article according to claim 3, wherein the surface layer consists essentially of 5 to 25 weight per cent tungsten (W) and 0.1 to 5 weight per cent carbon (C), cobalt (Co), nickel (Ni) or iron (Fe) or their alloys and optionally a grain growth inhibitor.

13. A cemented tungsten carbide article according to claim 1, which comprises an interlayer between the surface layer and the article core, the interlayer having a thickness of 0.5 to 40 micron and consisting of carbide grains and a binder comprising cobalt (Co), nickel (Ni) or iron (Fe); the binder content in the interlayer being higher compared to that of the core by at least 5 per cent.

14. A cemented tungsten carbide article according to claim 13, wherein the binder content in the interlayer gradually decreases from the surface layer to the core.

15. A cemented tungsten carbide article according to claim 3, which comprises an interlayer between the surface layer and the article core, the interlayer having a thickness of 0.5 to 40 micron and consisting of carbide grains and a binder comprising cobalt (Co), nickel (Ni) or iron (Fe); the binder content in the interlayer being higher compared to that of the core by at least 5 per cent.

16. A cemented tungsten carbide article according to claim 1, wherein the surface layer is under residual tensile strength of −10 to −500 megapascals (MPa).

17. A method of producing a cemented tungsten carbide, including the steps of:

forming a mixture of metal carbide grains and a binder selected from cobalt, iron and nickel, pressing the mixture into the form of an article, sintering the article at a sintering temperature of 1,400 to 1,500 degrees Celsius in a vacuum or inert gas under pressure, cooling the sintered article to a temperature at which the binder is substantially solid, the cooling taking place in an inert gas, nitrogen, hydrogen or a mixture thereof in at least three cooling stages, in which:

the average cooling rate is 0.01 to 4 degrees Celsius per minute;

the first stage cooling is from the sintering temperature to 1,380 degrees Celsius, the cooling rate of the first stage being higher than that of the second stage and higher than that of the third cooling stage by a factor of at least five;

the second cooling stage is from 1,380 degrees Celsius to 1,340 degrees Celsius, the cooling rate of the second stage being higher than that the second stage by a factor of two; and and the third cooling stage is from 1,340 degrees Celsius to 1,280 degrees Celsius and the cooling rate in the third cooling stage is from 0.01 to 1 degree Celsius per minute.

18. A method according to claim 17, wherein cooling from 1,280 degrees Celsius to 1,250 degrees Celsius takes place at a cooling rate which is the same as the third cooling stage.

* * * * *